US008382547B2

(12) United States Patent
Grisolia et al.

(10) Patent No.: US 8,382,547 B2
(45) Date of Patent: Feb. 26, 2013

(54) TOY PROJECTILE AND LAUNCHER

(75) Inventors: Nick Grisolia, Lake Geneva, WI (US); Peter Greenley, Lake Geneva, WI (US); John Vanderbeek, Edgewater, NJ (US)

(73) Assignee: G2 Inventions, LLC, Lake Geneva,, WI (US)

( * ) Notice: Subject to any disclaimer, the term of this patent is extended or adjusted under 35 U.S.C. 154(b) by 369 days.

(21) Appl. No.: 12/941,532

(22) Filed: Nov. 8, 2010

(65) Prior Publication Data

US 2012/0115391 A1 May 10, 2012

(51) Int. Cl.
*A63H 27/14* (2006.01)

(52) U.S. Cl. ..... 446/64; 446/62; 446/75; 446/80; 446/138; 446/430; 446/486; 446/487; 244/16; 244/63

(58) Field of Classification Search ..... 446/61–68, 446/75, 138, 429–430, 486–487, 76, 80; 244/63–64, 16; *A63H 27/00, 27/14, 29/00; B64F 1/04*

See application file for complete search history.

(56) References Cited

U.S. PATENT DOCUMENTS

| | | | | | |
|---|---|---|---|---|---|
| 1,842,434 | A * | 1/1932 | Tyrrell | 446/62 |
| 2,408,984 | A * | 10/1946 | Lawson, Sr. | 124/17 |
| 3,031,797 | A * | 5/1962 | Gelfand | 446/65 |
| 4,064,647 | A * | 12/1977 | Lemelson | 446/65 |
| 4,103,454 | A * | 8/1978 | Stone | 446/67 |
| 5,035,382 | A * | 7/1991 | Lissaman et al. | 244/190 |
| 6,179,680 | B1 * | 1/2001 | Hornsby et al. | 446/65 |
| 7,140,575 | B2 * | 11/2006 | McGeer et al. | 244/63 |
| 7,210,654 | B1 * | 5/2007 | Cox et al. | 244/63 |
| 8,146,855 | B2 * | 4/2012 | Ismailov | 244/49 |
| 2006/0038067 | A1 * | 2/2006 | Dennis | 244/63 |
| 2006/0186266 | A1 * | 8/2006 | Kennedy | 244/63 |
| 2006/0226284 | A1 * | 10/2006 | Poesch et al. | 244/63 |
| 2008/0132141 | A1 * | 6/2008 | Dorius | 446/61 |
| 2011/0147515 | A1 * | 6/2011 | Miller et al. | 244/63 |

FOREIGN PATENT DOCUMENTS

| | | |
|---|---|---|
| FR | 2555459 | * 5/1985 |
| JP | 2009285413 | * 12/2009 |
| WO | WO 2007146308 | * 12/2007 |

* cited by examiner

*Primary Examiner* — Gene Kim
*Assistant Examiner* — Matthew B Stanczak
(74) *Attorney, Agent, or Firm* — Adam K. Sacharoff

(57) ABSTRACT

A projectile and a compact carrying and launching case in combination. The projectile includes foldable wings which when unfolded resemble a plane. The compact carrying and launching case includes a two piece housing that is pivotally attached to each other about a hinge/launching mechanism. When closed, the two piece housing encloses the plane in its folded position. When opened, the hinge/launching mechanism can be pulled to a cocked position and then released forcibly moves the projectile such that it releases from the launching mechanism and is capable of flying.

10 Claims, 6 Drawing Sheets

100
105
110
200
210
212
215
220
300

Figure 4A
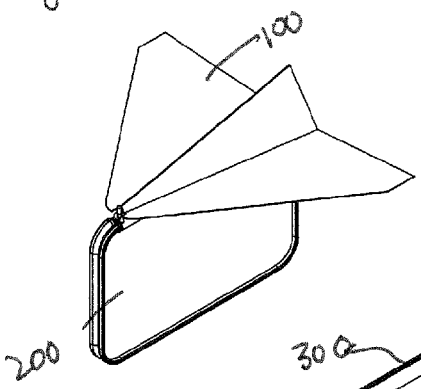
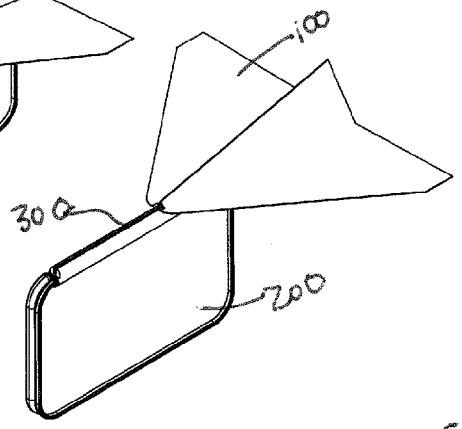
Figure 4B
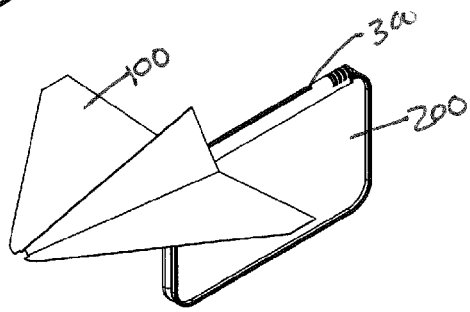
Figure 4C
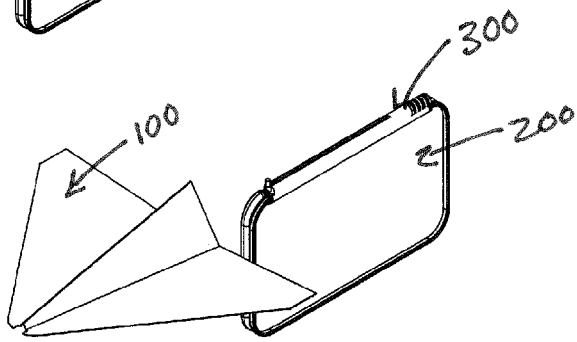
Figure 4D

Figure 5A
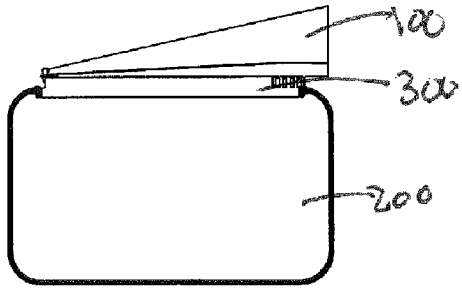
Figure 5B
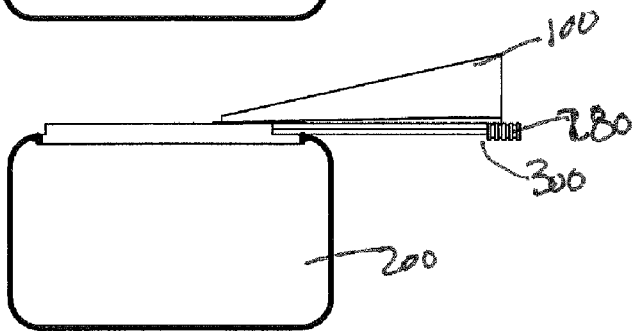
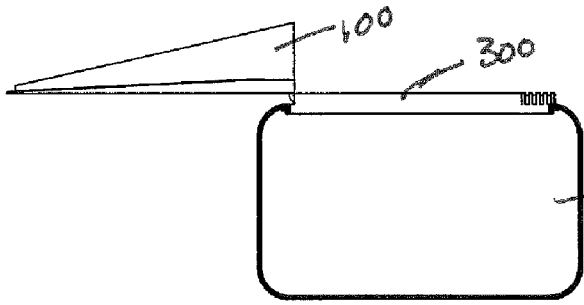
Figure 5C
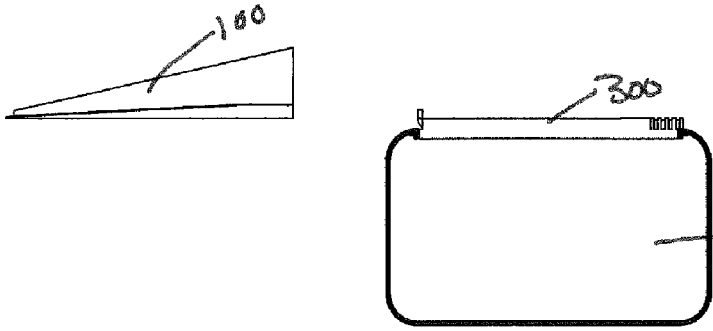
Figure 5D 100
200
300

100
280
270
217
222
215
220
135
215
240
250
242
200
220

A
100
200
A
300

TOY PROJECTILE AND LAUNCHER

BACKGROUND OF THE INVENTION

This invention relates to a toy composed of a projectile and a compact case used for storing the projectile and for launching the projectile into the air. The projectile of the invention has wings which are folded together when stored in the compact case but which unfold when the compact case is opened.

Devices are known for launching projectiles such as toy planes shown in U.S. Pat. No. 5,725,410. However, these devices require long tubes and require the user to whip the tube quickly in order to launch the projectile. This type of launcher prevents accuracy or the ability to aim the projectile. There is thus a need to provide for other types of projectiles and compact cases that can be used for launching the projectile.

SUMMARY OF THE INVENTION

One or more of the embodiments provided in the present invention relates to a projectile and a compact carrying and launching case in combination. The combination includes the projectile, which is defined by a main body having a pair of wings separately extending from either side of the main body. Each of the wings are inwardly foldable about the main body and are symmetrically disposed about the main body, wherein when the wings are in a position for flying, the wings extend substantially outwardly. The pair of wings being also inwardly foldable about the main body to a collapsible position. In addition, a front nose section is secured to the centered main body. The compact carrying and launching case is defined to include a housing having two sections. A hinge mechanism is pivotally attaching the two sections about a top edge, such that the two sections are capable of opening and closing. The housing forms an interior hollow region when closed and is capable of holding the projectile while the pair of wings are in the collapsible position. When the two sections are pivoted to an opened position, the pair of wings are capable of moving to the flying position. The hinge mechanism further includes a launching mechanism releasably secured to the front nose section of the projectile. The launching mechanism has a handle for moving the projectile to a cocked position, which when released forcibly permits the release of the projectile from the launching mechanism and the wings being in the flying position causes the projectile to fly.

In other embodiments, the projectile is made of a resilient material such that the wings have a tendency to move to a substantially outward position. In addition, the main body is further defined as an inverted V-shaped body capable of folding about a center line. Further embodiments may provide for a front nose which has a magnet used in combination with a magnetic element defined by the launching mechanism to magnetically secure the projectile to the launching mechanism.

In yet other embodiments, the two sections of the housing each are defined to have a backside wall having an edge that terminates into an outwardly extending side wall. The sidewall extends around a section of a periphery of the backside wall terminating at edges about a top portion defined of the backside wall, wherein the edges of the sidewall about the top portion include attachments to pivotally secure the two sections to a hinge.

In yet still further embodiments, the launching mechanism may includes a groove positioned in the hinge between its edges. A barrel is positioned within the groove, and includes a bore positioned in the barrel through a front end to a rear end such that an opening defined in the rear end of the barrel extends to the front end. The barrel further includes a slot extending along a topside of the barrel from the front end towards the rear end. The slot however terminates at a terminating edge near the rear end, such that the slot does not extend into the rear end. A spring is positioned in the bore of the barrel against the rear end. A rod is also provided and includes an upturned front end extending through the slot and includes a rear tip. The rear tip is sized to slide through the opening in the rear end of the barrel and is further secured to a handle, while the upturned front end is magnetically attached to the front nose. The handle when pulled back compresses the spring until the unturned front end of the rod comes in contact with the terminating edge of the slot thereby pulling the projectile back to the cocked position and when the handle is released the spring forces the unturned front end of the rod back towards the front end of the barrel such that the projectile is capable of magnetically releasing from the upturned end launching the projectile.

Numerous other advantages and features of the invention will become readily apparent from the following detailed description of the invention and the embodiments thereof, from the claims, and from the accompanying drawings.

DESCRIPTION OF THE DRAWINGS

A fuller understanding of the foregoing may be had by reference to the accompanying drawings, wherein:

FIGS. 4A-4D illustrates in various views the launching of the projectile from the compact case shown in perspective views;

FIGS. 5A-5D illustrates in various views the launching of the projectile from the compact case shown in side views.

DETAILED DESCRIPTION OF THE EMBODIMENTS

Figure 1:
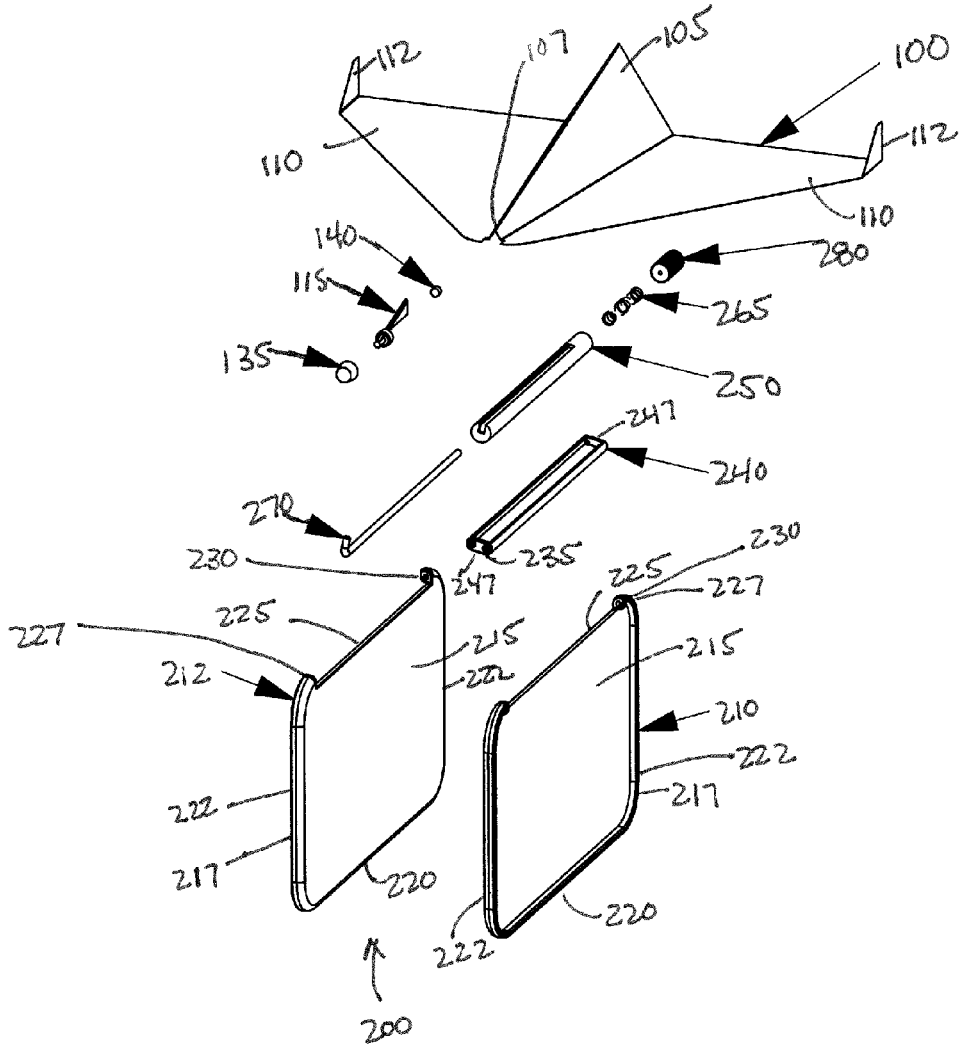
FIG. 1 is an exploded view of the projectile, launching mechanism, and compact case in accordance to one or more embodiments of the invention.
Figure 2:
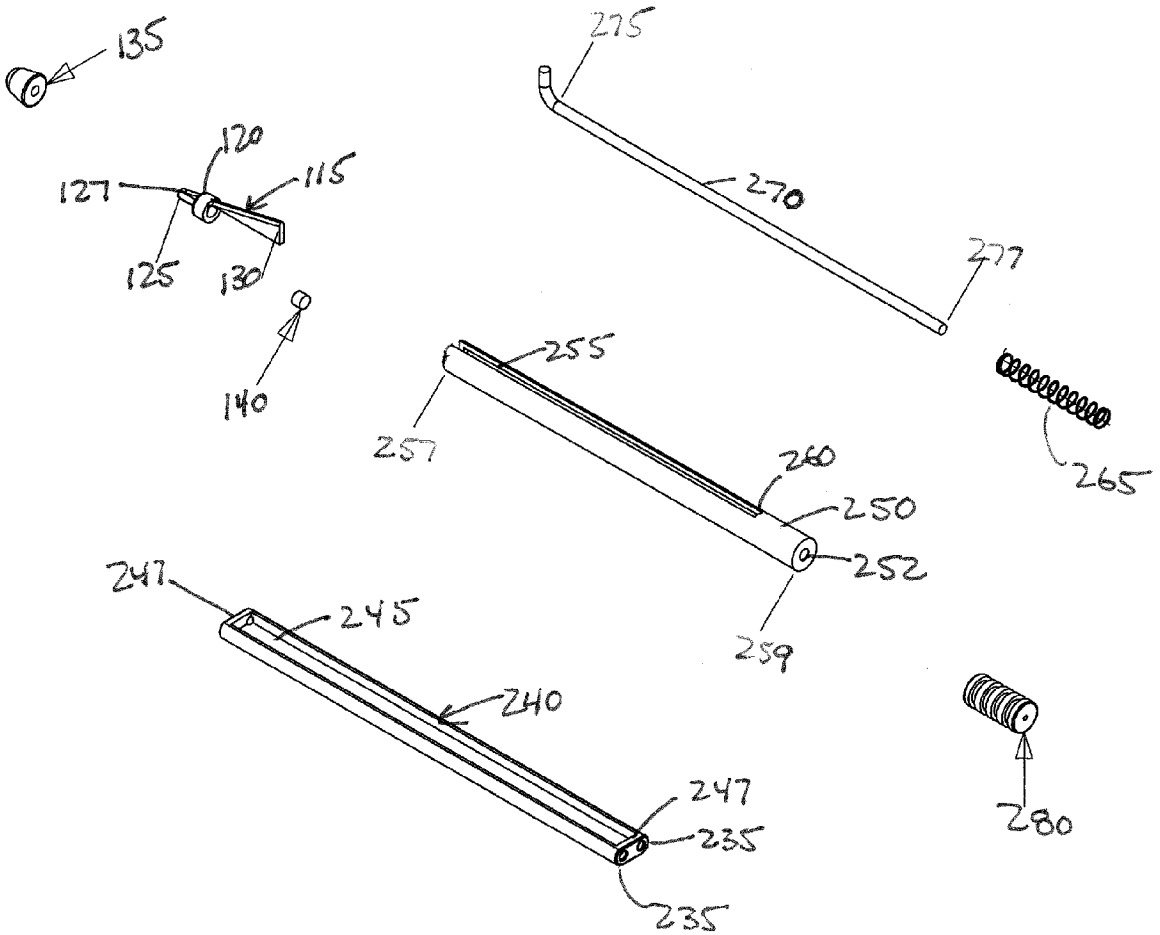
FIG. 2 is an exploded view of the compact case hinge, launching mechanism and components of the projectile.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to FIG. 1, there is provided a projectile 100 and a compact case 200 used for storing and launcher the projectile 100. As shown the projectile has a shape and design as a plane, however, various shapes and styles may be used without deviating from the spirit and scope of one or more of the embodiments presented herein.

The projectile 100 is composed of a main body 105 with wings 110. The main body 105 may include an inverted V-shaped body design. As explained below this may help with the folding of the projectile 100 when being stored. The wings 110 may also include end tips 112 turned to extend upwardly from the end of the wings 110. A front nose 115 is secured to a front section 107 of the main body 105. The front nose 115 includes an annular ring 120 vertically aligned with an U-shaped attachment 125 extending horizontally from the front side of the annular ring 120, while a short tail 130 extends from a rear side of the annular ring 120. The short tail 130 is used to secure the front nose 115 to the main body 105. Secured to the tip 127 of the U-shaped attachment 125 is a nose cone 135, typically made of a foam to help reduce the effect of an impact upon a surface or the ground during or after flight. A magnet 140 may further be provided and is inserted into the annular ring 120. The projectile is preferably constructed with a polyoxymethylene (commonly referred to as POM and also known as acetal, polyacetal or polyformaldehyde). This allows the projectile to be folded within the compact case when it is closed, but will automatically unfold into the specific shape or style designated when the compact case is opened.

The compact case 200 in comprised of a housing sectioned into two sections 210, 212. Each housing section includes a backside wall 215 having an edge that terminates into an outwardly extending side wall 217. The sidewall 217 will extend around the peripheries of a base 220, two sides 222 and a portion of a top 225 of the backside wall 215. The terminating edges 227 of the sidewall 217 about the top 225 of the backside wall 215 includes pins 230 or male extensions. The pins 230 are aligned to received openings 235 or female receivers on a two ends 247 on a hinge 240. It being known that the male/female connection can be reversed without deviating from the invention.

The hinge permits a full 180 degree pivot of the two sections 210 and 212 allowing the sections to close completely and open to a position that the two backside walls 215 touch. The hinge 240 is defined to have a groove 245 positioned between the two ends 247 that incorporate the openings 235. The groove 245 is sized to accommodate a barrel 250.

The barrel 250 is bored through from the front end 257 to the rear end 259 of the barrel, such that an opening 252 is defined in the rear end 259. The barrel 250 further includes a slot 255 extending along the top of the barrel 250. The slot is opened in the front end 257 of the barrel and extends towards the rear end 259 of the barrel 250. However the slot 255 does not extend into the rear end 259 as the slot terminates at a terminating edge 260 prior to the rear end 259. A compression spring 265 is positioned in the bore of the barrel 250 against the rear end 259. A rod 270 is provided with an upturned front end 275 and a rear tip 277. The rod 270 is sized such that the rear tip 277 is able to slide through the opening 252 in the rear end 259 of the barrel 250 and be secured to a handle 280. The handle 280 is used to pull the rod 270 through the bore until the upturned front end 275 comes in contact with the terminating edge 260. The upturned front end 275 as it approaches the terminating edge 260 will begin to compress the spring 265. When the handle 280 is released, the spring 265 forces the upturned front end 275 of the rod 270 towards the front end 257 of the barrel 250.

To attached the projectile 100 to the launcher mechanism 300 in the compact case 200, the upturned front end 275 of the rod 270 is magnetically attached to the magnet 140 in the front nose 115.

Figures 3A, 3B, 3C, 3D, 3E, 3F, 3G, 3H, 3I, 3J, 3K, 3L, 3M:
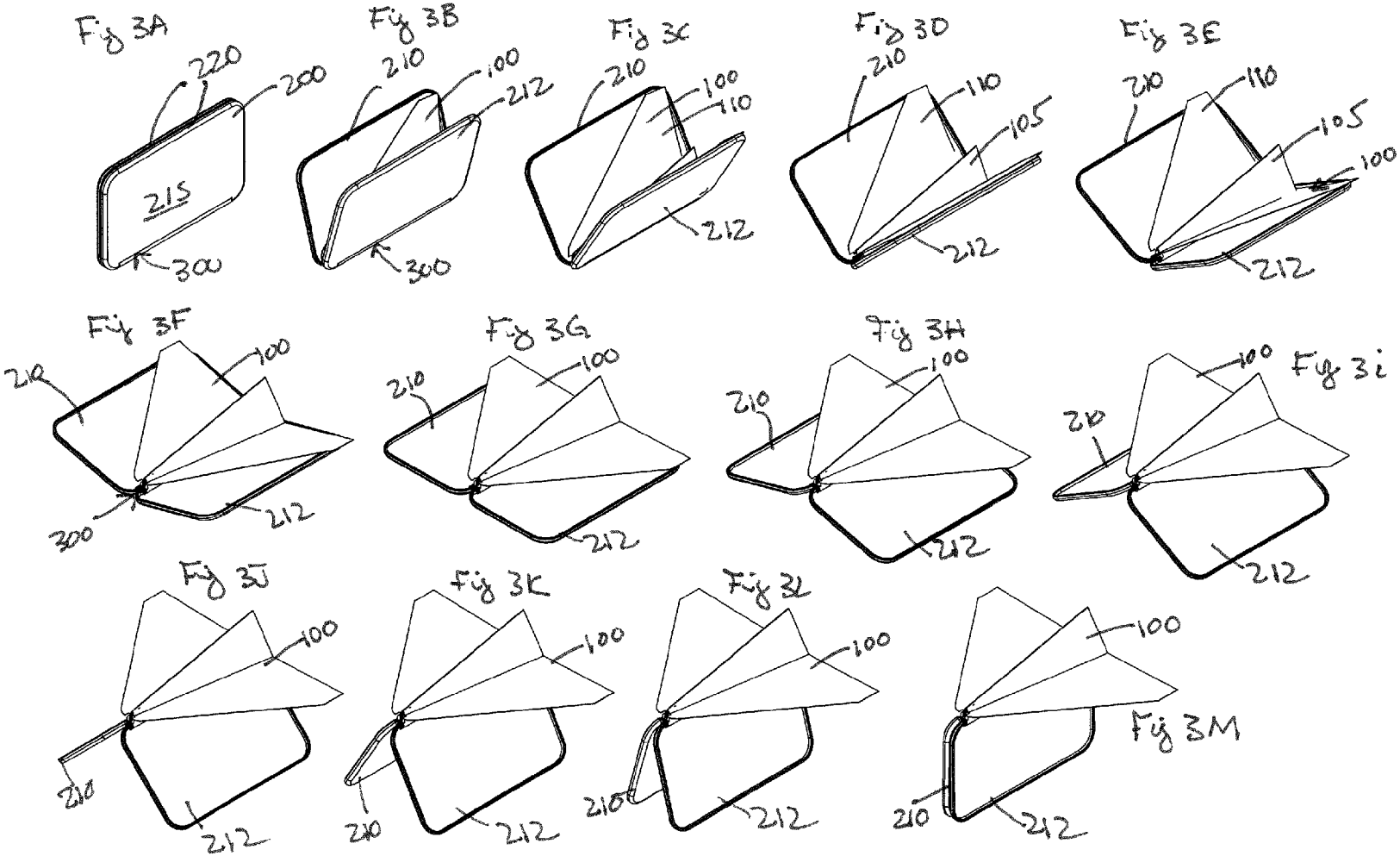
FIGS. 3A-3M illustrate in various views the opening of the compact case and unfolding of the projectile.
Figures 6A, 6B, 6C:
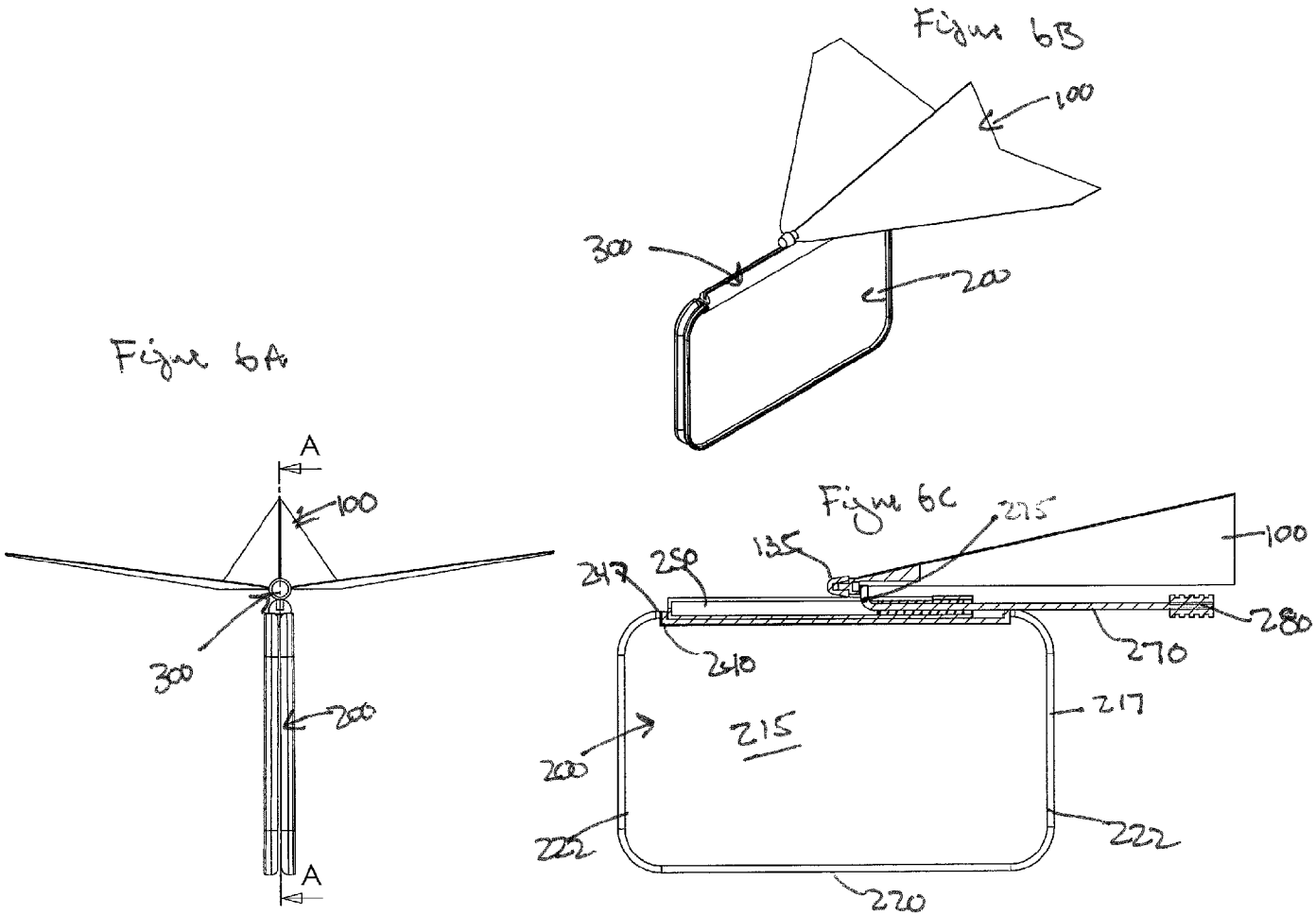
FIGS. 6A-6C illustrates in various views the projectile sitting at a half release position.

Once assembled and the projectile 100 is attached to the launcher mechanism, the compact case 200 can be closed, shown in FIG. 3*a*. As viewed from FIGS. 3A to 3M, the compact case 200 can be opened. As it is opening, the two sections 210, 212 are separated about the bottom edge 220 and pivoted about the hinge 250. The sides are pivoted until the two backside walls 215 are touching (FIG. 3M). As illustrated, when closed the sidewall 217 extending from the backside wall 215 creates a pocket for storing the folded projectile. During the opening of the compact case 200, the projectile 100 is unfolded and yet remains secured to the launcher mechanism. When launching the projectile, (illustrated in FIGS. 4A-4D; 5A-5D; and 6A-6C), the projectile 100 is pulled back along the launcher mechanism 300. By holding the handle 280, the user pulls the rod 270 compression the spring 265 between the upturned end 275 and the rear end 259 of the barrel 250. The user releases the handle 280, FIG. 4C/5C, and the compression spring returns the rod 270 back to its original position and the projectile 100 quickly releases from its magnetic attraction to the upturned end.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A projectile and a compact carrying and launching case in combination, the combination comprising:

the projectile defined to include:

a main body having a pair of wings separately extending from either side of the main body, each of the wings being inwardly foldable about the main body and being symmetrically disposed about the main body, wherein when said wings are in a position for flying, the wings extend substantially outwardly, and the pair of wings being inwardly foldable about the main body to a collapsible position, and a front nose section secured to the centered main body; and the compact carrying and launching case defined to include:

a housing having two sections, a hinge mechanism pivotally attaching the two section about a top edge, such that the two sections are capable of opening and closing, the housing forming an interior hollow region when the two housing sections are in a closed position and capable of holding the projectile while the pair of wings are in the collapsible position, and wherein when the two sections are pivoted to an opened position, the pair of wings are capable of moving to the flying position; and the hinge mechanism further including a launching mechanism releasably secured to the front nose section of the projectile, the launching mechanism having a handle for moving the projectile to a cocked position, which when released forcibly permits the release of the projectile from the launching mechanism and the wings being in the flying position causes the projectile to fly.

2. The combination of claim 1, wherein the projectile is made of a resilient material such that the wings have a tendency to move the wings to a substantially outward position.

3. The combination of claim 1, wherein the main body is further defined as an inverted V-shaped body capable of folding about a center line.

4. The combination of claim 1, wherein the front nose includes a magnet used in combination with a magnetic element defined by the launching mechanism to magnetically secure the projectile to the launching mechanism.

5. The combination of claim 1, wherein the two sections of the housing each includes:

a backside wall having an edge that terminates into an outwardly extending side wall, the sidewall extends around a section of a periphery of the backside wall terminating at edges about a top portion defined of the backside wall, wherein the edges of the sidewall about the top portion include attachments to pivotally secure the two sections to a hinge.

6. The combination of claim 5, wherein the launching mechanism includes:

a groove positioned in the hinge between the edges, a barrel sized for positioning within the groove, the barrel includes a bore positioned in the barrel through a front end to a rear end such that an opening defined in the rear end of the barrel extends to the front end, the barrel further includes a slot extending along a topside of the barrel from the front end towards the rear end, the slot terminated at a terminating edge near the rear end, such that the slot does not extend into the rear end, a spring positioned in the bore of the barrel against the rear end, and a rod having an upturned front end extending through the slot and a rear tip, the rear tip being sized to slide through the opening in the rear end of the barrel and is further secured to a handle, the upturned front end being magnetically attached to the front nose, whereby the handle when pulled back is capable of compressing the spring until the unturned front end of the rod comes in contact with the terminating edge of the slot and thereby pulling the projectile back to the cocked position and when the handle is released the spring forces the unturned front end of the rod back towards the front end of the barrel such that the projectile is capable of magnetically releasing from the upturned end launching the projectile.

7. A projectile and a compact carrying and launching case in combination, the combination comprising:

the projectile defined to include:

a main body having a pair of wings separately extending from either side of the main body, each of the wings being inwardly foldable about the main body and being symmetrically disposed about the main body, wherein when said wings are in a position for flying, the wings extend substantially outwardly, and the pair of wings being inwardly foldable about the main body to a collapsible position, and a front nose section secured to the centered main body, wherein the front nose includes a magnet; and the compact carrying and launching case defined to include:

a housing having two sections, a hinge mechanism pivotally attaching the two section about a top edge, such that the two sections are capable of opening and closing, the housing forming an interior hollow region when the two housing sections are in a closed position and capable of holding the projectile while the pair of wings are in the collapsible position, and wherein when the two sections are pivoted to an opened position, the pair of wings are capable of moving to the flying position; and the hinge mechanism further including a launching mechanism releasably secured to the front nose section of the projectile, the launching mechanism having a handle for moving the projectile to a cocked position, which when released forcibly permits the release of the projectile from the launching mechanism and the wings being in the flying position causes the projectile to fly; and wherein the launching mechanism includes:

a groove positioned in the hinge between the edges, a barrel sized for positioning within the groove, the barrel includes a bore positioned in the barrel through a front end to a rear end such that an opening defined in the rear end of the barrel extends to the front end, the barrel further includes a slot extending along a topside of the barrel from the front end towards the rear end, the slot terminated at a terminating edge near the rear end, such that the slot does not extend into the rear end, a spring positioned in the bore of the barrel against the rear end, and a rod having an upturned front end extending through the slot and a rear tip, the rear tip being sized to slide through the opening in the rear end of the barrel and is further secured to a handle, the upturned front end being magnetically attached to the magnet in the front nose, and whereby the handle when pulled back is capable of compressing the spring until the unturned front end of the rod comes in contact with the terminating edge of the slot and thereby pulling the projectile back to the cocked position and when the handle is released the spring forces the unturned front end of the rod back towards the front end of the barrel such that the projectile is capable of magnetically releasing from the upturned end launching the projectile.

8. The combination of claim 7, wherein the projectile is made of a resilient material such that the wings have a tendency to move the wings to a substantially outward position.

9. The combination of claim 7, wherein the main body is further defined as an inverted V-shaped body capable of folding about a center line.

10. The combination of claim 7, wherein the two sections of the housing each includes:

a backside wall having an edge that terminates into an outwardly extending side wall, the sidewall extends around a section of a periphery of the backside wall terminating at edges about a top portion defined of the backside wall, wherein the edges of the sidewall about the top portion include attachments to pivotally secure the two sections to a hinge.

* * * * *